US006336492B1

(12) United States Patent
Nagaoka

(10) Patent No.: US 6,336,492 B1
(45) Date of Patent: Jan. 8, 2002

(54) MOUNTING HEAD APPARATUS AND MOUNTING METHOD

(75) Inventor: Tsutomu Nagaoka, Tochigi (JP)

(73) Assignee: Sony Chemicals Corporation, Tokyo (JP)

( * ) Notice: Subject to any disclaimer, the term of this patent is extended or adjusted under 35 U.S.C. 154(b) by 0 days.

(21) Appl. No.: 09/427,554

(22) Filed: Oct. 27, 1999

(30) Foreign Application Priority Data

Oct. 30, 1998 (JP) ..... 10-311339

(51) Int. Cl.[7] ..... B65C 9/26

(52) U.S. Cl. ..... 156/538; 156/556; 156/230; 156/285; 269/21

(58) Field of Search ..... 156/230, 285, 156/538, 539, 556, 558; 269/21; 248/309.3

(56) References Cited

U.S. PATENT DOCUMENTS 3,893,881 A * 7/1975 Gerber et al. ..... 156/250
5,177,857 A * 1/1993 Ito ..... 269/21
6,173,648 B1 * 1/2001 Misono et al. ..... 269/21

* cited by examiner

*Primary Examiner*—Steven D. Maki
*Assistant Examiner*—John T. Haran
(74) *Attorney, Agent, or Firm*—Jay H. Maioli

(57) ABSTRACT

A mounting head apparatus for adsorbing and moving a sheet member to a position above an object on which the sheet member is to be mounted and mounting the adsorbed sheet member on the object includes an adsorbing portion having a plurality of adsorbing openings formed at the leading end thereof; a connection chamber to which the adsorbing portion is joined and which is formed into a space for connecting the base portions of the plural adsorbing openings to one another; a dividing unit disposed in the connection chamber and arranged to divide the internal space of the connection chamber into a plurality of sections; and a pressure reducing unit connected to the connection chamber and arranged to reduce the pressure in the connection chamber, wherein adsorbing force is generated from a portion of the plural adsorbing openings in a predetermined region when the dividing unit divides the inside portion of the connection chamber at a predetermined position and the pressure in at least one of the divided connection chambers is reduced by the pressure reducing unit.

7 Claims, 6 Drawing Sheets

MOUNTING HEAD APPARATUS AND MOUNTING METHOD

BACKGROUND OF THE INVENTION

1. Field of the Invention

The present invention relates to a mounting head apparatus for adsorbing and moving a sheet member to a position above a required object and placing the sheet on the object and a mounting method.

2. Description of the Related Art

In general, a so-called mounting head apparatus is employed to coat an object with a sheet member after the sheet has been registered to a predetermined position. The mounting head apparatus is employed, for example, when an adhesive sheet composed of an adhesive layer and a separable film is mounted on a portion for establishing the connection between a liquid crystal panel and a TAB. When an anisotropic and conductive adhesive sheet is mounted on a predetermined position of a flexible printed substrate, also a mounting head apparatus of the foregoing type is employed.

As shown in FIG. 1, the mounting head apparatus incorporates a head 101 for adsorbing a sheet member 100, a moving means (not shown) for moving the head 101 and a vacuum pump 102 for generating adsorbing force for the head 101. The head 101 has a plurality of adsorbing openings (not shown) formed in parallel with one another in one direction. Therefore, suction force is generated in the plural adsorbing openings owning to the operation of the vacuum pump 102 so that adsorption of the sheet member 100 is permitted.

In a state of the mounting head apparatus in which the sheet member 100 has been adsorbed by the head 101, the moving means moves the head 101 to a position above an object 103 on which the sheet member 100 must be mounted. The mounting head apparatus is structured such that the head 101 holding the sheet member 100 adsorbed thereto is brought into contact with the object 103. Then, generation of the adsorbing force is interrupted so that the sheet member 100 is mounted on the object 103.

For example, an anisotropic and conductive adhesive sheet is allowed to adhere to a predetermined position of a flexible printed substrate as follows: the anisotropic and conductive adhesive sheet (hereinafter called an "ACF") formed into a predetermined shape is allowed to adhere to the flexible printed substrate (hereinafter called a "FPC") by the foregoing mounting head apparatus (temporal adhesion). Then, a heating head or the like is operated to allow the ACF and the FPC to completely adhere to each other (main adhesion).

The mounting head apparatus structured as described above enables the predetermined sheet member 100 to easily be mounted on a required position of the object 103. Therefore, the operation for mounting the sheet member 100 has substantially been automated.

At present, reduction of sizes of electronic apparatuses incorporating FPC and so forth has caused the sizes of the FPC and so forth to be reduced. Hence it follows that also the foregoing sheet member, such as the ACF, must considerably accurately be mounted on an object on which the sheet member must be mounted and which has reduced size.

The foregoing mounting head apparatus has the structure that the suction force is generated in the plural adsorbing openings formed in one direction. Therefore, the sheet member 100 must have the size with which all of the plural adsorbing openings can be covered to realize sufficiently large force for adsorbing the sheet member 100. That is, a portion of the adsorbing openings which does not adsorb the sheet member 100 deteriorates the effect of the negative pressure. Therefore, the force for adsorbing the sheet member 100 becomes insufficient.

To prevent the foregoing problem, a method may be employed with which change to a head 101 corresponding to a small sheet member 100 is performed. Another method may be employed with which a portion of the adsorbing openings is masked to correspond to the small sheet member 100. The operation for changing the head 101 and that for performing masking are very complicated operations, causing the productivity to excessively deteriorate. Although each of the foregoing methods is able to generate the adsorbing force corresponding to the small sheet member 100, there arises a problem in that the force for adsorbing a large sheet member 100 is insufficiently small when the large and small sheet members 100 are alternately mounted.

SUMMARY OF THE INVENTION

To prevent the problems experienced with the conventional mounting head apparatus and the mounting method, an object of the present invention is to provide a mounting head apparatus and a mounting method each of which is capable of satisfactorily adsorbing any one of sheet members regardless of the size of the sheet member and accurately mounting the sheet member on a required position on an object.

To achieve the above-mentioned object, according to one aspect of the present invention, there is provided a mounting head apparatus for adsorbing and moving a sheet member to a position above an object on which the sheet member must be mounted and mounting the adsorbed sheet member on the object, the mounting head apparatus comprising an adsorbing portion having a plurality of adsorbing openings formed at the leading end thereof; a connection chamber to which the adsorbing portion is joined and which is formed into a space for connecting the base portions of the plural adsorbing openings to one another; dividing means disposed in the connection chamber and arranged to divide the internal space of the connection chamber into a plurality of sections; and pressure reducing means connected to the connection chamber and arranged to reduce the pressure in the connection chamber, wherein adsorbing force is generated from a portion of the plural adsorbing openings in a predetermined region when the dividing means divides the inside portion of the connection chamber at a predetermined position and the pressure in at least either of the divided connection chambers is reduced by the pressure reducing means.

The mounting head apparatus according to the present invention and structured as described above incorporates the dividing means which is capable of dividing the connection chamber at a required position. The mounting head apparatus reduces the pressure in at least either of the divided connection chambers to generate adsorbing force. At this time, the dividing means of the mounting head apparatus determines the dividing position in the connection chamber according to the size of the sheet member which must be adsorbed. As a result, the mounting head apparatus according to the present invention is able to generate the adsorbing force from the adsorbing openings formed in a predetermined region according to the size of the sheet member. Thus, the mounting head apparatus is able to adsorb a sheet member having a predetermined size.

To achieve the foregoing object, according to another aspect of the present invention, there is provided a mounting method arranged to adsorb and move a sheet member to a position above an object on which the sheet member must be mounted and mount the adsorbed sheet member on the object, the mounting head method comprising the steps of: using a mounting head apparatus incorporating an adsorbing portion having a plurality of adsorbing openings formed at the leading end thereof, a connection chamber to which the adsorbing portion is joined and which is formed into a space for connecting the base portions of the plural adsorbing openings to one another, dividing means disposed in the connection chamber and arranged to divide the internal space of the connection chamber into a plurality of sections, and pressure reducing means connected to the connection chamber and arranged to reduce the pressure in the connection chamber; causing the dividing means to divide the inside portion of the connection chamber at a predetermined position; and causing the pressure reducing means to reduce the pressure in at least either of the divided connection chambers so that adsorbing force is generated from a portion of the plural adsorbing openings in a predetermined region, and the adsorbing force is used to adsorb the sheet member.

The mounting method according to the present invention and structured as described above causes the dividing means to divide the connection chamber at a required position. Moreover, the pressure in at least either of the divided connection chambers is reduced to generate adsorbing force in predetermined adsorbing openings to adsorb the sheet member. Therefore, the method according to the present invention arranged to adjust the dividing means to control the position at which the connection chamber is divided is able to generate adsorbing force from a portion of the plural adsorbing openings in required region. Thus, the foregoing method enables the region in which the adsorbing force is generated to be adjusted according to the size of the sheet member so that the sheet member is adsorbed.

DESCRIPTION OF THE PREFERRED EMBODIMENTS

Embodiments of a mounting head apparatus and a mounting method according to the present invention will now be described with reference to the drawings.

Figure 1:
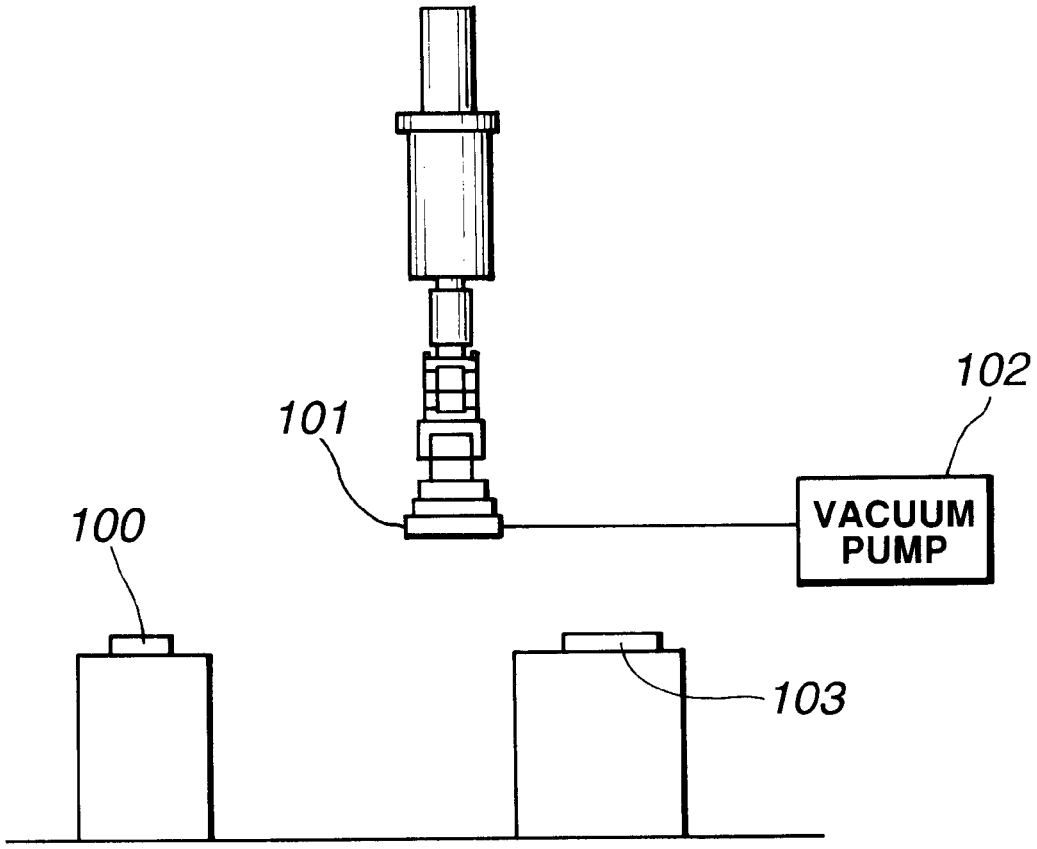
FIG. 1 is a schematic view showing a conventional mounting head apparatus.
Figure 2:
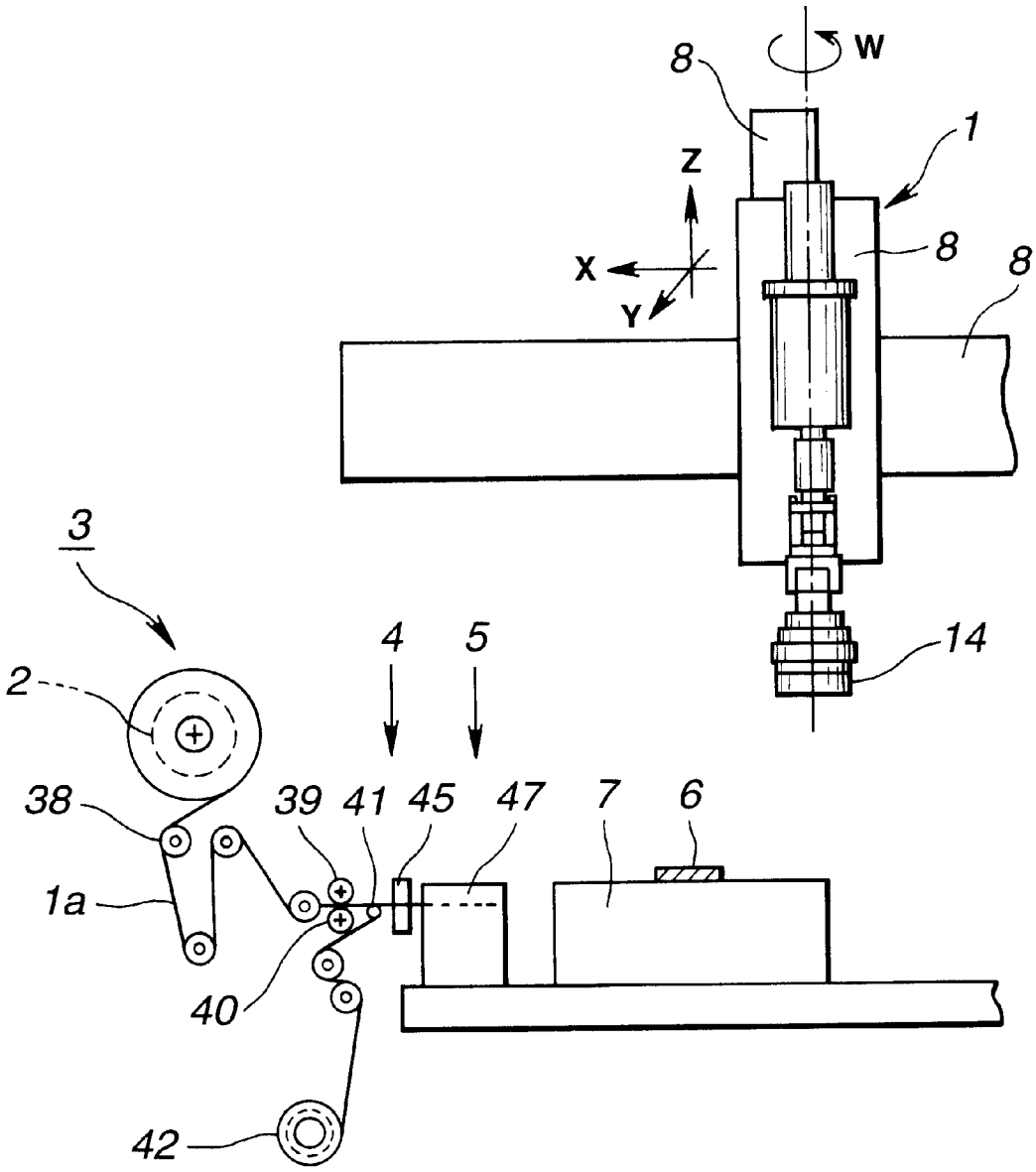
FIG. 2 is a schematic view showing an ACF-sheet mounting apparatus incorporating a mounting head apparatus according to the present invention.

An example of the mounting head apparatus according to the present invention is a mounting head apparatus 1 structured as shown in FIG. 2 and arranged to mount an anisotropic and conductive adhesive sheet on a predetermined position of a flexible printed substrate. Note that the mounting head apparatus and the mounting method according to the present invention are not limited to the foregoing apparatus. The present invention may be applied when an adhesive sheet is sandwiched between a liquid crystal panel and a TAB as a step of manufacturing a liquid crystal image display apparatus.

An ACF-sheet mounting apparatus shown in FIG. 2 is constituted by the mounting head apparatus 1, a supply portion 3 for drawing an anisotropic and conductive adhesive sheet (hereinafter abbreviated as an "ACF sheet") 1*a* from a supply reel 2, a cutting portion 4 for cutting the ACF sheet 1*a* supplied from the supply portion 3 to have a predetermined length, a temporal receiving portion 5 for holding the ACF sheet 1*a* cut by the cutting portion 4 and a table 7 on which an object 6, on which the sheet must be mounted and which is hereinafter simply called an "object 6", is secured. That is, the ACF-sheet mounting apparatus is constituted by the mounting head apparatus 1, the supply portion 3, the cutting portion 4, the temporal receiving portion 5 and the table 7.

The ACF-sheet mounting apparatus 1 incorporates a moving means 8 which is capable of moving the mounting head apparatus 1 in any one of directions X, Y and Z shown in FIG. 2. The mounting head apparatus 1 can be rotated in a direction indicated with an arrow W shown in FIG. 2. As a result, the ACF-sheet mounting apparatus is able to move the mounting head apparatus 1 to a required position.

Figure 3:
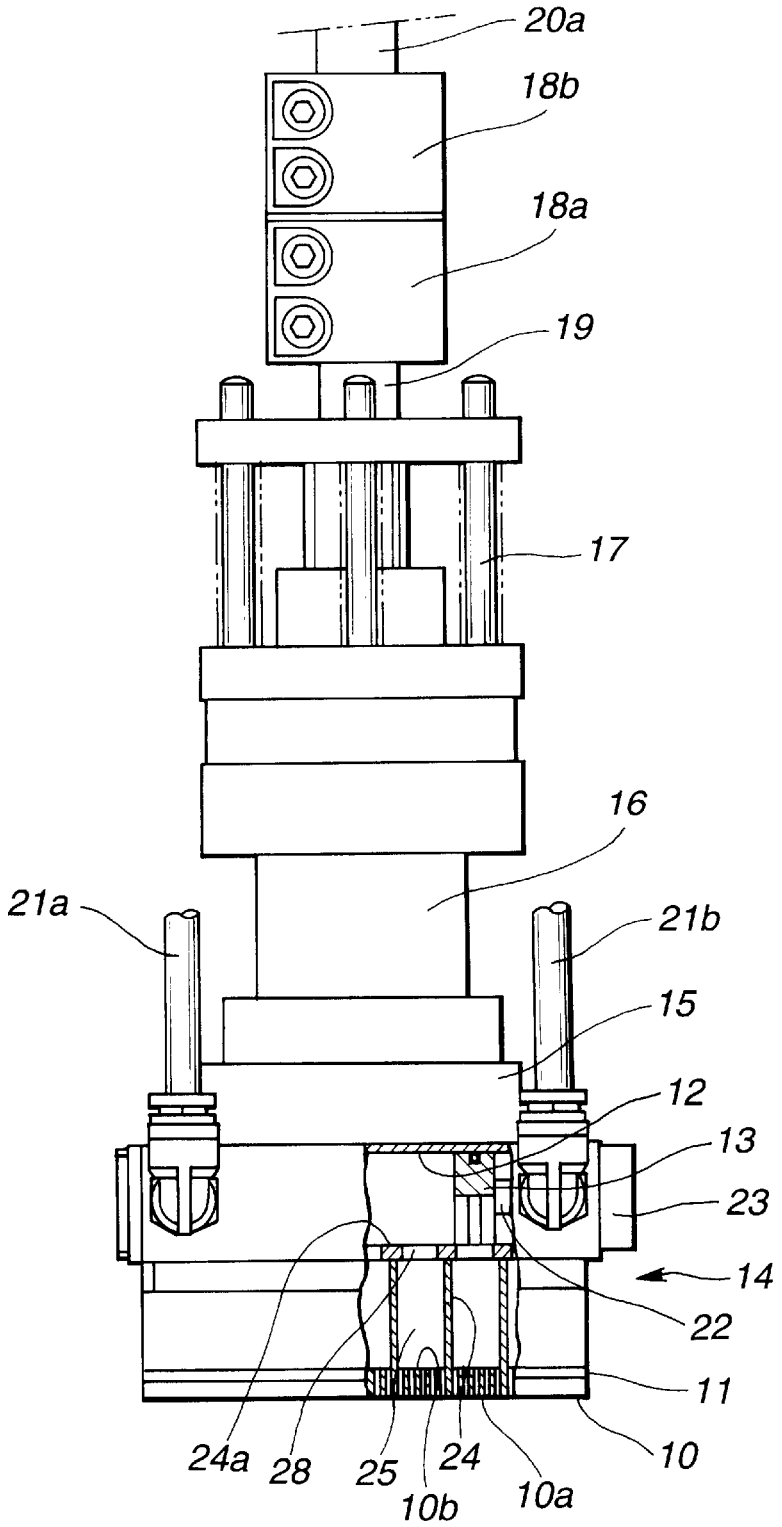
FIG. 3 is a partial cross sectional view showing an essential portion of the mounting head apparatus according to the present invention.

As shown in FIG. 3, the mounting head apparatus 1 incorporates a head portion 14 having an adsorbing portion 11, which has a plurality of adsorbing openings 10*a* formed at a leading end 10 by drilling, a connection chamber 12 to which the adsorbing portion 11 is joined and which is formed into a space in which base portions 10*b* of the plural adsorbing openings 10*a* are connected to one another and a piston head 13 which is a dividing means disposed in the connection chamber 12 and which divides the inside portion of the connection chamber 12 into a plurality of sections. Moreover, the mounting head apparatus 1 incorporates a heat insulation member 15 to which the head portion 14 is joined, a joining portion 16 for joining the heat insulation member 15 and the head portion 14 and a damper portion 17 for damping force which is exerted in the direction Z. In addition, a mount-head-side shaft 19 and a moving-means-side shaft 20 of the mounting head apparatus 1 are connected to each other through joints 18*a* and 18*b*.

Moreover, the mounting head apparatus 1 incorporates a pair of exhaust pipes 21*a* and 21*b* joined to the connection chamber 12 and a pressure reducing means (not shown), for example, a vacuum pump, connected to the pair of exhaust pipes 21*a* and 21*b*. It is preferable that one vacuum pump is joined to each of the pair of the exhaust pipes 21*a* and 21*b*. Thus, the pressure of the internal portion of the connection chamber 12 can individually be reduced by the pair of the exhaust pipes 21*a* and 21*b*.

In addition, the mounting head apparatus 1 incorporates a piston shaft 22, which has an end joined to the piston head 13, and an electric piston operating unit 23 joined to another end of the piston shaft 22 and arranged to cause the piston shaft 22 and the piston head 13 to integrally perform piston actions.

In the mounting head apparatus 1, the adsorbing portion 11 has a plurality of partition walls 24 disposed between the leading end 10 and the connection chamber 12. That is, the adsorbing portion 11 has a plurality of cylindrical connection holes 25 each of which has a depth which reaches the leading end 10. The partition wall 24 is disposed between the adjacent connection holes 25. Thus, the partition walls 24 are formed at substantially the same intervals in a direction in parallel with a direction in which the adsorbing openings 10*a* are formed. Moreover, the connection holes 25 connect the leading end 10 and the connection chamber 12 to each other. Hence it follows that the adsorbing portion 11 structured as described above is formed such that the plural adsorbing openings 10*a* open in the surface of the bottom of each of the connection holes 25.

Figure 4:
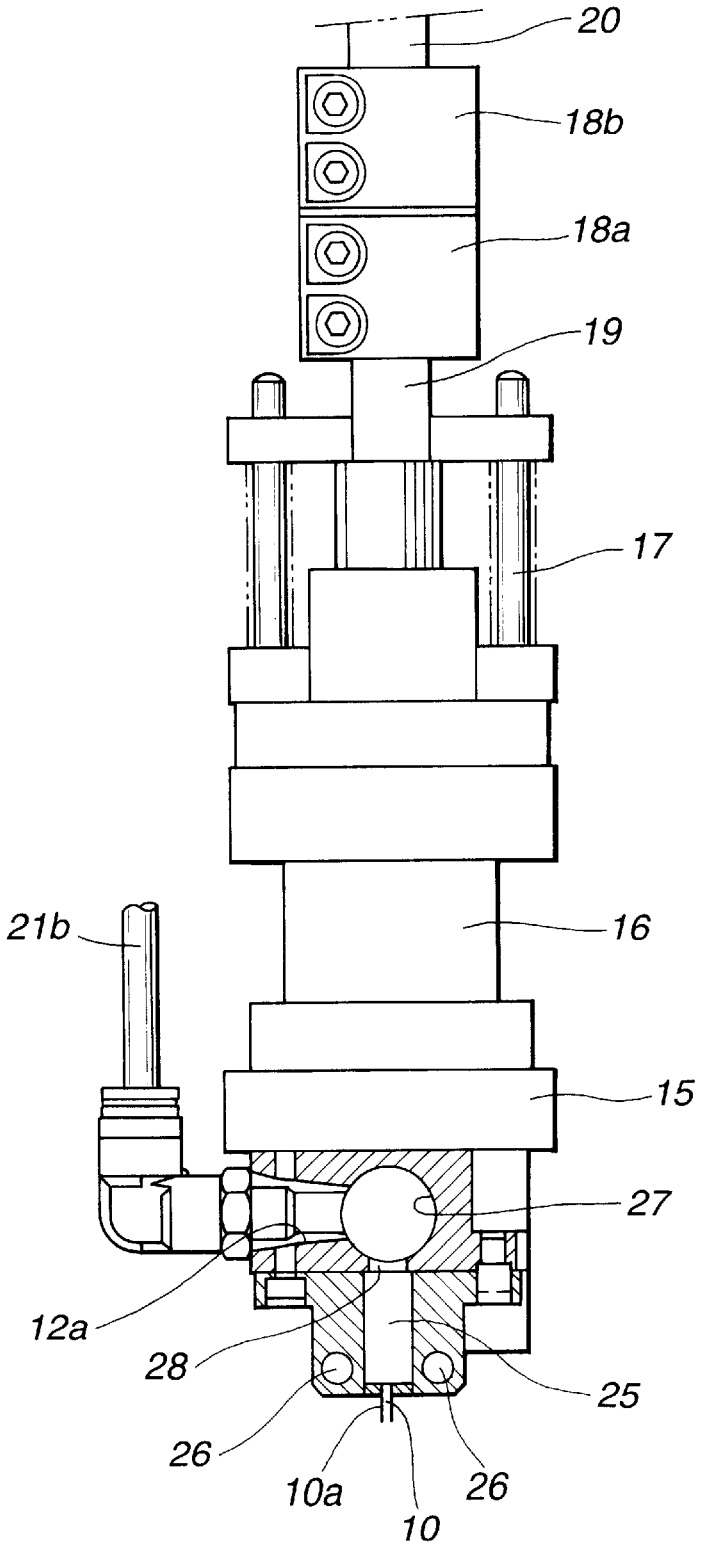
FIG. 4 is a partial cross sectional view showing an essential portion of the mounting head apparatus when it is viewed from a side position.

As shown in FIG. 4, the adsorbing portion 11 has a pair of heaters 26 disposed in parallel with the direction in which the leading end 10 are formed. The pair of the heaters 26 are able to heat portions around the adsorbing openings 10*a*, that is, the leading end 10.

The connection chamber 12 of the mounting head apparatus 1 is formed by drilling substantially the central portion of a metal block in the form of a substantially rectangular parallelepiped shape into a substantially cylindrical form so that an internal space 27 is formed. Then, one side surface of the metal block is drilled to have a predetermined width so that a groove 28 is formed through which a portion of the internal space 27 is exposed to the outside. Moreover, a pair of openings are so formed in the other side surface of the connection chamber 12 as to reach the internal space 27. Thus, a portion 12*a* for connecting the pair of the exhaust pipes 21*a* and 21*b* to each other is formed.

The connection chamber 12 and the adsorbing portion 11 are integrated with each other so that the head portion 14 is formed. In the head portion 14 formed by integrating the connection chamber 12 and the adsorbing portion 11 with each other, an upper surface 24*a* of the partition walls 24 is positioned in the groove 28 of the connection chamber 12. Thus, the internal space 27 and the adsorbing openings 10*a* are connected to one another through the connection holes 25 so that an integrated space is formed in the head portion 14.

Figure 5:
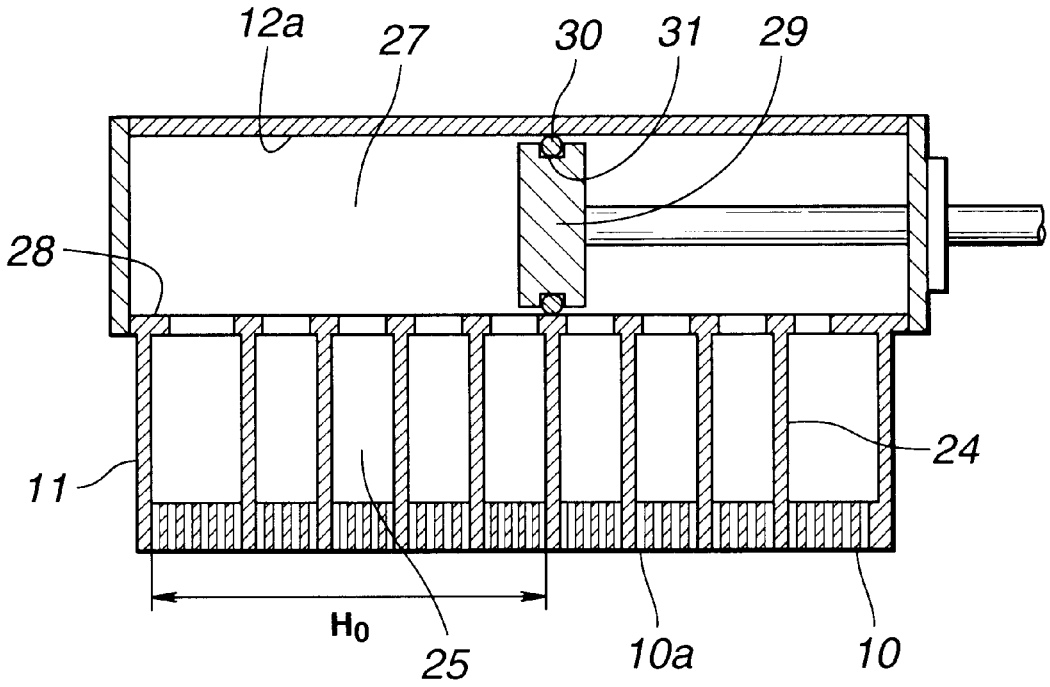
FIG. 5 is a cross sectional view showing a head portion.

The piston head 13 and the piston shaft 22 are disposed in the connection chamber 12. As shown in FIG. 5, the piston head 13 incorporates a columnar member 29, which has a diameter somewhat smaller than the inner diameter of the cylindrical internal space 27 formed by drilling, and a sealing member 30 wound around the columnar member 29. The columnar member 29 has an outer groove 31 formed in the outer surface thereof and having a predetermined depth. The sealing member 30 is wound in the outer groove 31 formed in the outer surface of the columnar member 29.

It is preferable that the sealing member 30 is made of an elastic material, such as rubber. The sealing member 30 wound around the outer groove 31 has a thickness with which the diameter including the sealing member 30 is made to be larger than the diameter of the columnar member 29. Therefore, the sealing member 30 wound around the outer groove 31 projects over the outer surface of the columnar member 29. In a state in which the sealing member 30 has been wound around the outer groove 31, the diameter of the piston head 13 is somewhat larger than the inner diameter of the internal space 27.

Hence it follows that the piston head 13 is press-fit into the internal space 27. The piston head 13 is disposed in such a manner that the side wall which constitutes the internal space 27 and the sealing member 30 are brought into hermetic contact with each other. Moreover, the upper surface 24*a* of the partition walls 24 facing the groove 28 and the sealing member 30 are brought into hermetic contact with each other. Thus, the inside portion of the internal space 27 is divided into two spaces by the piston head 13.

Figure 6:
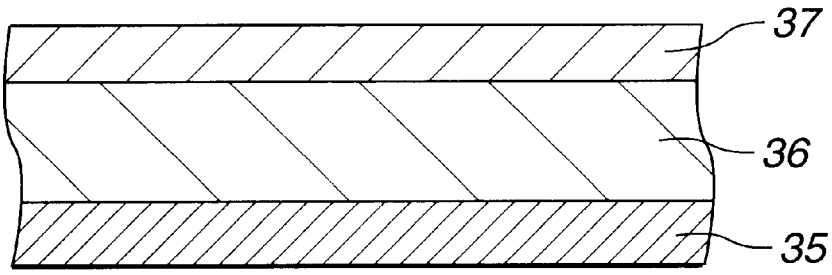
FIG. 6 is a cross sectional view showing an essential portion of an ACF sheet.

As shown in FIG. 6, the ACF sheet 1*a* for use in the ACF-sheet mounting apparatus is formed by sequentially laminating a separable film 35, an adhesive layer 36 and a protective layer 37. After the protective layer 37 has been removed, the ACF sheet 1*a* is cut to have a predetermined length, and then the ACF sheet 1*a* is mounted on a predetermined position of the flexible printed substrate.

As shown in FIG. 2, the supply portion 3 of the ACF-sheet mounting apparatus incorporates a supply reel 2 around which the ACF sheet 1*a* has been wound, a plurality of guide rollers 38 along which the ACF sheet 1*a* drawn from the supply reel 2 is moved, a conveyance roller 39 and a pressurizing roller 40 for holding the drawn ACF sheet 1*a* under a predetermined pressure, a separator block 41 disposed in the rear of the conveyance roller 39 and the pressurizing roller 40 to remove the protective layer 37 from the ACF sheet 1*a* and a take-up reel 42 for taking up the protective layer 37 separated by the separator block 41.

The ACF sheet 1*a* is wound around the supply reel 2 in such a manner that the protective layer 37 of the ACF sheet 1*a* is the inner layer. Therefore, in the supply portion 3, the ACF sheet 1*a* runs along the guide rollers 38 and so forth in such a manner that the protective layer 37 is positioned in the lower position. Since the ACF sheet 1*a* runs along a plurality of guide rollers 38, a predetermined tension can be obtained.

A rotating means, such as a motor (not shown), is joined to the conveyance roller 39 in the supply portion 3. Therefore, the conveyance roller 39 is rotated in a state in which the ACF sheet 1*a* is sandwiched between the conveyance roller 39 and the pressurizing roller 40. Thus, the ACF sheet 1*a* can be drawn from the supply reel 2. When a nip between the conveyance roller 39 and the pressurizing roller 40 is adjusted, the length of the ACF sheet 1*a* which must be drawn from the supply reel 2 can be controlled.

The separator block 41 is disposed in the rear of the conveyance roller 39 and the pressurizing roller 40 such that the separator block 41 is disposed adjacent to the protective layer 37 of the drawn ACF sheet 1*a*. The separator block 41 separates the protective layer 37 of the running ACF sheet 1*a* from the ACF sheet 1*a*. The separated protective layer 37 is taken up by the take-up reel 42. The rotating apparatus, such as a motor, is connected to the take-up reel 42. When the take-up reel 42 is rotated, the separated protective layer 37 can reliably be taken up.

The cutting portion 4 of the ACF-sheet mounting apparatus incorporates a cutter 45 for cutting the ACF sheet 1*a* and a control unit (not shown) for controlling the operation of the cutter 45. Since timing at which the cutter 45 is operated is controlled by the control unit, the cutting portion 4 is able to cut the ACF sheet 1*a* at a predetermined position.

Figure 7:
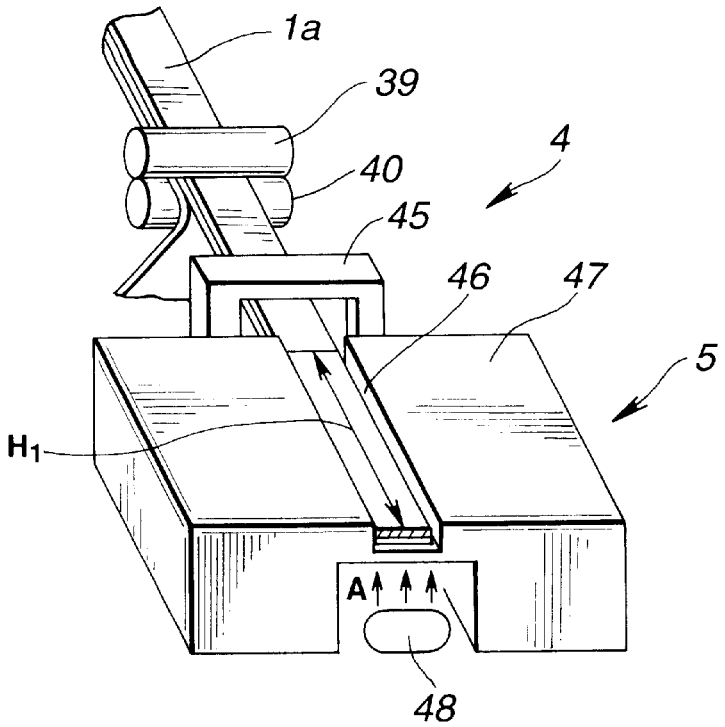
FIG. 7 is an enlarged perspective view showing a temporal receiving portion of the ACF-sheet mounting apparatus.

As shown in FIG. 7, the temporal receiving portion 5 has a temporal receipt frame 47 provided with a groove 46 having a width which is somewhat larger than the width of the ACF sheet la. When the ACF sheet 1*a* is supplied to the temporal receiving portion 5, the ACF sheet 1*a* is introduced along the surface of the bottom of the groove 46. Therefore, the ACF sheet 1*a* can be held in the temporal receiving portion 5 without any deviation in the position in the widthwise direction of the ACF sheet 1*a*.

The size of the groove 46 is determined to permit introduction of the leading end 10 of the mounting head apparatus 1. It is preferable that the temporal receiving portion 5 is provided with a cooling means for cooling the temporal receiving portion 5 to a degree with which formation of a tuck of the heaters 26 of the ACF sheet 1*a* can be prevented. A specific method of cooling the temporal receipt frame 47 will now be described. For example, an air-cooling apparatus, which is a cooling apparatus, may be provided for the inside portion of the temporal receipt frame 47 to blow cold air A to the bottom wall of the groove 46, as indicated with an arrow A. The temperature and the quantity of cold air which must be blown as described above must be determined to correspond to the temperature to which the head portion 14 is heated, the thickness of the bottom wall and the type of the adhesive layer of the ACF sheet 1*a*. In general, it is preferable that the temperature and the quantity are determined to lower the temperature of the surface of the bottom of the temporal receipt frame 47 to about 10° C. or lower. The cooling means may be a water-cooling-type cooling apparatus or an electronic cooling apparatus, as well as the air-cooling apparatus.

In the ACF-sheet mounting apparatus structured as described above, the ACF sheet 1*a* wound around the supply reel 2 is cut to have a predetermined size. Then, the mounting head apparatus 1 mounts the cut ACF sheet 1*a* on the object 6.

Initially, the ACF sheet 1*a* is, in the supply portion 3, sandwiched between the guide rollers 38 and the pressurizing roller 40. Moreover, the ACF sheet 1*a* is routed to the plural guide rollers 38. When the conveyance roller 39 has been rotated in the foregoing state, the ACF sheet 1*a* is drawn from the supply reel 2. Since the ACF sheet 1*a* is routed to the plural guide rollers 38, the ACF sheet 1*a* is able to move under a predetermined tension.

The protective layer 37 of the ACF sheet 1*a* is separated from the ACF sheet 1*a* by the separator block 41 so that a state in which the separable film 35 and the adhesive layer 36 are laminated is realized. Then, the ACF sheet 1*a* is supplied to the temporal receiving portion 5. The ACF sheet 1*a* is cut to have a predetermined size in the cutting portion 4 formed between the supply portion 3 and the temporal receiving portion 5. That is, the cutter 45 of the cutting portion 4 controlled by the control unit cuts the ACF sheet 1*a* at a predetermined position. Thus, the ACF sheet 1*a* having a predetermined size is supplied to the temporal receiving portion 5. The ACF sheet 1*a* supplied to the temporal receiving portion 5 is brought to a state in which the separable film 35 is positioned in the upper portion and the adhesive layer 36 is positioned adjacent to the temporal receiving portion 5.

As shown in FIG. 7, the ACF sheet 1*a* is introduced into the temporal receiving portion 5 along the surface of the bottom of the groove 46. Therefore, the adhesive layer 36 of the ACF sheet 1*a* and the surface of the bottom of the groove 46 are brought into contact with each other. That is, when a predetermined length of the ACF sheet 1*a* has been supplied to the temporal receiving portion 5 of the ACF-sheet mounting apparatus, movement of the ACF sheet 1*a* owing to the rotations of the conveyance roller 39 is interrupted. Then, the cutter 45 of the cutting portion 4 is operated by the control unit so that the ACF sheet 1*a* is cut. The ACF sheet 1*a* cut to have an elongated shape is held in the temporal receiving portion 5 until the ACF sheet la is moved by the mounting head apparatus 1.

Then, the ACF sheet 1*a* is moved from the temporal receiving portion 5 to a position above the object 6 by the mounting head apparatus 1.

Initially, the electric piston operating unit 23 of the mounting head apparatus 1 moves the piston head 13 to a predetermined position. Specifically, the length ($H_1$ shown in FIG. 7) of the ACF sheet 1*a* supplied to a position above the groove 46 and the length ($H_0$ shown in FIG. 5) of a portion of the plural adsorbing openings connected to the connection chamber 12*a* and which generates the adsorbing force are made to be substantially the same.

In the mounting head apparatus 1, only the vacuum pump connected to the exhaust pipe 21*a* of the exhaust pipes 21*a* and 21*b* is operated to produce a vacuum through the exhaust pipe 21*a*. Thus, the pressure in a connection chamber 12*a* of the two connection chamber 12 divided by the piston head 13 is reduced. As a result, adsorbing force is generated from the plural adsorbing openings 10*a* connected to the connection chamber 12*a* of the connection chamber 12.

Then, the mounting head apparatus 1 is operated arbitrarily in the directions X, Y, Z and W shown in FIG. 2. Thus, the mounting head apparatus 1 is located in such a manner that the lengthwise direction of the ACF sheet 1*a* inserted into the groove 46 and the direction in which the adsorbing openings 10*a* are formed are made to be paralleled to each other. The mounting head apparatus 1 is moved in the direction Z (downwards) to bring the ACF sheet 1*a* and the leading end 10 into contact with each other.

As a result, adsorbing force from the adsorbing openings 10*a* of the mounting head apparatus 1 is used to cause the ACF sheet 1*a* to be adsorbed to the leading end 10. In a state in which the ACF sheet 1*a* has been adsorbed, the mounting head apparatus 1 is moved to the directions X, Y, Z and W in FIG. 2. Thus, the mounting head apparatus 1 is moved to a position above the object 6 secured to the upper surface of the table 7. Then, the mounting head apparatus 1 is moved in the direction Z (downwards) in FIG. 2 so that the ACF sheet 1*a* is mounted on the object 6 under a predetermined pressure. As a result, the ACF sheet 1*a* is mounted on the object 6 such that the adhesive layer 36 is made contact with the object 6. Specifically, exhaust from the exhaust pipe 21*a* is interrupted and the object 6 is pressed by the leading end 10 under a predetermined pressure. Thus, the ACF sheet 1*a* can be separated from the leading end 10.

Since the damper portion 17 is provided for the mounting head apparatus 1, contact of the leading end 10 with the object 6 is made under a required pressure. That is, the damper portion 17 of the mounting head apparatus 1 is able to absorb excessive shock. Therefore, the leading end 10 does not damage the object 6.

In the mounting head apparatus 1, the leading end 10 is heated to a predetermined temperature by the pair of the heaters 26. Therefore, the adhesive force of the adhesive layer 36 is generated so that the ACF sheet 1*a* is reliably and temporarily secured to a predetermined region of the object 6.

As described above, the head portion 14 of the mounting head apparatus 1 of the ACF-sheet mounting apparatus is heated so that the ACF sheet 1*a* is heated and allowed to adhere to the upper surface of the object 6. Specifically, heating and adhesion are performed at about 40° C. to about 150° C. When the pair of the heaters 26 are operated to perform heating and adhesion, it is preferable that the heaters 26 are always turned on in place of an operation that the heaters 26 are turned on only when the heating and adhesion are performed. Thus, the heating and adhesion efficiency can be improved. If the heaters 26 are always turned on, heat of the heaters 26 is conducted to the ACF sheet 1*a* when the ACF sheet 1*a* held by the temporal receiving portion 5 is adsorbed. Thus, there is apprehension that the ACF sheet 1*a* is allowed to undesirably adhere to the temporal receiving portion 5. When the temporal receiving portion 5 is cooled as described above, the foregoing problem can be overcome.

The mounting head apparatus 1 is structured such that the position of the piston head 13 is controlled so that the inside portion of the connection chamber 12 is divided at a required position. Specifically, the mounting head apparatus 1 is structured such that the sealing member 30 of the piston head 13 is so positioned as to be made contact with the upper surface 24*a* of the partition walls 24. Therefore, the inside portion of the connection chamber 12 is divided into spaces. At this time, the position at which the connection chamber 12 is divided is determined according to the size of the ACF sheet 1*a* held by the temporal receiving portion 5. As a result, the mounting head apparatus 1 is arranged such that adsorbing force is generated from the adsorbing openings 10*a* in the region corresponding to the size of the ACF sheet la. Hence it follows that the ACF sheet 1*a* can reliably be adsorbed.

In particular, the mounting head apparatus is able to reliably adsorb the ACF sheet 1*a* if the length of the ACF sheet 1*a* with respect to the length of the adsorbing openings 10*a* in the direction in which the adsorbing openings 10*a* are formed is ¼ or shorter. The conventional mounting head apparatus having no dividing means has been operated such that ¾ or more adsorbing openings 10*a* does not adsorb the ACF sheet 1*a* and generates adsorbing force when the length of the ACF sheet 1*a* with respect to the length of the adsorbing openings 10*a* in the direction in which the adsorbing openings 10*a* are formed is ¼ or shorter. In the foregoing case, the portion not smaller than ¾ of the adsorbing openings 10*a* which does not adsorb the ACF sheet 1*a* encounters deterioration in the negative pressure effect.

On the other hand, the mounting head apparatus 1 according to this embodiment can be operated such that the generation of the adsorbing force from the portion which does not adsorb the ACF sheet 1*a* is inhibited. Therefore, a very small ACF sheet 1*a* can be adsorbed with the conventional adsorbing force.

When the mounting head apparatus 1 mounts a plurality of ACF sheets 1*a* having different sizes, the position of the piston head 13 is sequentially changed according to the size of the ACF sheet 1*a* which must be mounted. Thus, the ACF sheet 1*a* having the different sizes can reliably be mounted.

When the length of one of the ACF sheets 1*a* is substantially the same as that of the leading end 10 and the length of the other ACF sheet 1*a* is relatively short, the piston head 13 is initially located according to the length of the other ACF sheet 1*a*. Therefore, the pressure in the divided connection chamber 12*a* is reduced through one of the exhaust pipes 21*a*. Thus, adsorbing force with which the ACF sheet 1*a* can be adsorbed can be generated from predetermined adsorbing openings 10*a*. When the pressure is reduced by using the pair of the exhaust pipes 21*a* and 21*b*, the pressure of the overall inside portion of the connection chamber 12 can be reduced. As a result, adsorbing force can be generated from all of the adsorbing openings 10*a*. Thus, adsorbing force with which the other ACF sheet 1*a* can be adsorbed can be generated.

As described above, the mounting head apparatus 1 enables pressures of the divided portions in the connection chamber 12 to independently be reduced by different exhaust pipes 21*a* and 21*b*. Therefore, when use of the exhaust pipes 21*a* and 21*b* is controlled, the region for generating adsorbing force can sequentially be changed. Hence it follows that the necessity of shifting the position of the piston head 13 can be eliminated to reliably mount the ACF sheets 1*a* having different sizes by controlling reduction in the pressure of each of the divided portions in the connection chamber 12.

Figure 8:
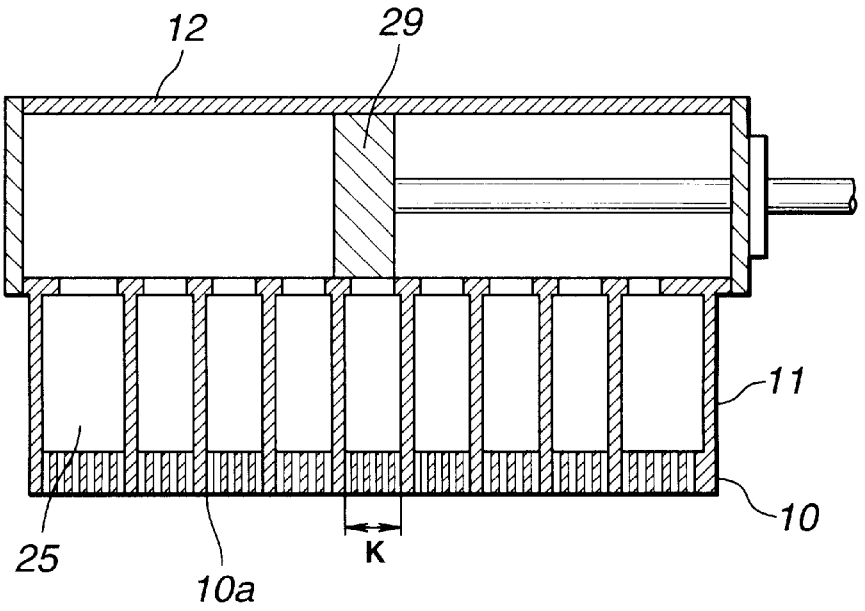
FIG. 8 is a cross sectional view showing another head portion of the mounting head apparatus according to the present invention.

The foregoing mounting head apparatus 1 is structured such that the sealing member 30 of the piston head 13 is brought into contact with the inner surface of the internal space 27 and the upper surface 24*a* of the partition walls 24. Thus, the connection chamber 12 is divided. Therefore, the mounting head apparatus 1 is enabled to obviate apprehension that a portion of the plural adsorbing openings 10*a* is closed by the piston head 13 and thus the adsorbing force cannot be generated. That is, when the piston head 13 is constituted by only columnar member 29 having a predetermined thickness as shown in FIG. 8, a region (indicated with symbol K shown in FIG. 8) from which adsorbing force cannot be generated always exists. In the foregoing case, there is apprehension that the mounting head apparatus 1 cannot uniformly adsorb the overall portion of a relatively long ACF sheet 1*a* in the lengthwise direction.

In order to improve the workability in an operation for allowing to adhere the ACF sheet la, the mounting head apparatus 1 according to this embodiment may be provided with a variety of additional means. The additional means are, for example, a camera for recognizing the position of the object 6 secured to the table 7 and a computer apparatus for moving the mounting head apparatus 1 in accordance with an image photographed by the camera. Thus, all of the steps for allowing the ACF sheet 1*a* to adhere to the object and the following steps to separation and removal of a separable film can completely be automated.

The adhesion of the sheet member which is performed by operating the mounting head apparatus according to this embodiment or adhesion of the sheet member which is performed by the mounting method according to this embodiment may be applied to a variety of sheet-shape adhesive agents. The present invention is not limited to the materials, thicknesses and so forth of the adhesive layer, the separable film, the protective film and so forth. For example, the present invention may be applied to an adhesive operation of a teflon sheet incorporating an adhesive layer, which has a thickness of about 5 $\mu$m to about 50 $\mu$m and which is made of anisotropic and conductive adhesive agent and a separable film having a thickness of about 10 $\mu$m to 100 $\mu$m, PET paper subject to a separating process and an anisotropic and conductive adhesive sheet composed of polypropylene film and so forth.

Also the object 6 is not limited particularly. The object 6 may be a rigid member made of liquid crystal panel glass or the like or a flexible member, such as a film substrate made of TAB or the like.

As described above, the mounting head apparatus according to the present invention has the dividing means which is capable of dividing the connection chamber at a required position. The pressure of at least either of the divided portions of the connection chamber is reduced to generate the adsorbing force. Thus, the mounting head apparatus according to the present invention enables only the adsorbing openings formed in a predetermined region to generate the adsorbing force according to the size of the sheet member. Hence it follows that the sheet member having a predetermined size can reliably be adsorbed. As a result, the mounting head apparatus is able to reliably mount a sheet member regardless of the size of the sheet member.

The mounting method according to the present invention is structured to operate the dividing means to divide the connection chamber at a required position. The pressure of at least either of the divided portions of the connection chamber to cause the adsorbing force from predetermined adsorbing openings to adsorb the sheet member. Therefore, the foregoing method is able to reliably adsorb the sheet member by adjusting the region from which the adsorbing force is generated according to the size of the sheet member. As a result, the sheet member can reliably be mounted on a predetermined position of the object on which the sheet member must be mounted.

Although the invention has been described in its preferred form and structure with a certain degree of particularity, it is understood that the present disclosure of the preferred form can be changed in the details of construction and in the combination and arrangement of parts without departing from the spirit and the scope of the invention as hereinafter claimed.

What is claimed is:

1. A mounting head apparatus for adsorbing and moving a sheet member to a position above an object on which the sheet member must be mounted and mounting the adsorbed sheet member on the object, said mounting head apparatus comprising:

an adsorbing portion having a plurality of adsorbing openings formed at a leading end thereof;

a connection chamber to which said adsorbing portion is joined and which includes an internal space for connecting base portions of said plural adsorbing openings to one another;

dividing means disposed in said connection chamber and arranged to divide an internal space of said connection chamber into a plurality of sections; and pressure reducing means Connected to said connection chamber and arranged to reduce a pressure in said connection chamber, wherein adsorbing force is generated from a portion of said plural adsorbing openings in a predetermined region when said dividing means divides the internal space of said connection chamber at a predetermined position to form divided connection chambers and the pressure in at least one of the divided connection chambers is reduced by said pressure reducing means, and wherein said dividing means is a piston having a piston head which is capable of moving in a lengthwise direction of said connection chamber.

2. A mounting head apparatus according to claim 1, further comprising moving means for moving said piston head to a predetermined position in said connection chamber.

3. A mounting head apparatus according to claim 1, wherein a sealing member is wound around said piston head.

4. A mounting head apparatus according to claim 1, wherein said pressure reducing means independently reduces the pressure in each of the connection chambers divided by said dividing means.

5. A mounting head apparatus according to claim 1, further comprising heating means joined to said adsorbing portion and arranged to heat said adsorbing portion.

6. A mounting head apparatus according to claim 1, further comprising a pressurizing means for pressurizing the sheet member in a state in which the sheet member adsorbed by said adsorbing portion is placed on the object.

7. A mounting head apparatus according to claim 1, wherein said pressure reducing means is individually joined to each of the divided connection chambers divided by said dividing means.

* * * * *